US008342527B2

(12) United States Patent
Wu

(10) Patent No.: US 8,342,527 B2
(45) Date of Patent: Jan. 1, 2013

(54) FIVE-BY FIVE CUBE PUZZLE

(76) Inventor: Cheng-Han Wu, Tainan (TW)

( * ) Notice: Subject to any disclaimer, the term of this patent is extended or adjusted under 35 U.S.C. 154(b) by 135 days.

(21) Appl. No.: 13/079,377

(22) Filed: Apr. 4, 2011

(65) Prior Publication Data

US 2012/0248696 A1 Oct. 4, 2012

(51) Int. Cl.
*A63F 9/08* (2006.01)

(52) U.S. Cl. ..... 273/153 S

(58) Field of Classification Search ..... 273/153 S, 273/153 R
See application file for complete search history.

(56) References Cited

U.S. PATENT DOCUMENTS 4,421,311 A * 12/1983 Sebesteny ..... 273/153 S
5,271,688 A * 12/1993 Chang ..... 273/153 S
5,826,871 A * 10/1998 Li ..... 273/153 S
5,992,850 A * 11/1999 Li ..... 273/153 S
6,129,356 A * 10/2000 Li ..... 273/153 S
7,600,756 B2 * 10/2009 Verdes ..... 273/153 S
2008/0303211 A1 * 12/2008 La et al. ..... 273/153 S
2009/0127783 A1 * 5/2009 Paquette ..... 273/153 S

* cited by examiner

*Primary Examiner* — Steven Wong
(74) *Attorney, Agent, or Firm* — Birch, Stewart, Kolasch & Birch, LLP

(57) ABSTRACT

A five-by-five cube puzzle has a central shaft assembly mounted around by center blocks in predetermined numbers, first intermediate blocks, second intermediate blocks, first edge blocks, second edge blocks and corner blocks. Each center shaft of a multi-axis shaft unit of the central shaft assembly is combined with a movable inner shield. An outer shield is mounted on an outside of a corresponding inner shield with a spring and a screw. The inner shields and the outer shields are combined with the first intermediate blocks, second intermediate blocks, first edge blocks, second edge blocks and corner blocks to form the cube puzzle. Based on rotation of those blocks with respect to the relative movement between inner shields and outer shields and sufficient gap among each block and a corresponding inner shield and outer shield, smooth rotation of each block can be achieved without being affected by slightly skew block alignment.

3 Claims, 15 Drawing Sheets

FIVE-BY FIVE CUBE PUZZLE

BACKGROUND OF THE INVENTION

1. Field of the Invention

The present invention relates to a cube puzzle, and more particularly to a combined structure of an educational five-by-five cube puzzle having smooth rotation without unrotatable layers of blocks due to slightly skew block alignment.

2. Description of the Related Art

Conventional cube puzzles have different choices of cube sizes, such as 2×2×2, 3×3×3, 4×4×4 and larger cube sizes. As the cube sizes increase, the cube puzzles become more and more complicated in terms of the individual parts and the entire structure. Basically, each conventional cube puzzle has a central shaft and multiple blocks mounted on the central shaft and being pivotally rotatable with respect to the central shaft so as to generate diversified cube puzzles. Different colors and patterns are formed on the sides of each block. To solve a cube puzzle, users must keep rotating the blocks of the cube puzzle until each side of the cube puzzle shows a same color.

The cube puzzles have been widespread and popular since the first appearance, and the combined structure thereof has been also developed for over three decades. However, as far as the 5×5×5 cube puzzles are concerned, although each layer of the cube puzzles is normally rotatable, the blocks of each layer of the cube puzzles to be rotated may be locked and unrotatable when the layer of blocks slightly deviates from their supposed position. Such phenomenon arises from excessive friction among the blocks and low manufacturing tolerances of the gaps between the blocks, and thus results in an awkward operation and unsmooth moves of the cube puzzles when the user attempts to solve the cube puzzles.

SUMMARY OF THE INVENTION

An objective of the present invention is to provide a five-by-five cube puzzle having smooth rotation without unrotatable layers of blocks due to slightly skew block alignment.

To achieve the foregoing objective, the five-by-five cube puzzle has a central shaft assembly, six center blocks, twenty four first intermediate blocks, twenty four second intermediate blocks, twelve first edge blocks, twenty four second edge blocks and eight corner blocks.

The central shaft assembly has a multi-axis shaft unit, six inner shields and six outer shields. The multi-axis shaft unit has a base and six center shafts. The center shafts are formed on the base to respectively point to six mutually perpendicular directions. Each inner shield has an inner arch plate being square and detachably mounted around one of the center shafts. Each outer shield has an outer arch plate, a protruded shaft, a spring and a screw. The outer arch plate is square. The protruded shaft is formed on and protrudes inwardly from an inner side of the outer arch plate, and is centrally mounted through the inner shield. The spring is mounted in the outer shield. The screw is screwed into one of the center shafts through the spring so that a corresponding outer shield is movable along an axial direction of the protruded shaft and a stroke of movement of the outer shield is limited by an overall length of the screw.

Each center block has a square plate centrally mounted on the outer arch plate of one of the outer shields.

The first intermediate blocks are divided into six sets respectively mounted around the center blocks. Each first intermediate block has a square plate and a junction portion. One edge of the square plate adjoins a corresponding edge of the square plate of a corresponding center block. The junction portion detachably engages the outer arch plate of one of the outer shields, and has two ears respectively formed on and protruding from two sides of the junction portion, and each ear detachably abuts against an edge of the outer arch plate of a corresponding outer shield.

Each second intermediate block is mounted between two adjacent first intermediate blocks, is diagonally adjacent to one corner of one of the center blocks and has a square plate and an assembly portion. Two edges of the square plate respectively adjoin two edges of the square plates of two adjacent first intermediate blocks. The assembling portion is formed on an inner side of the second intermediate block and detachably engages the outer arch plate of one of the outer shields.

The first edge blocks are mounted between two adjacent first intermediate blocks on two adjacent sides of the cube puzzle. Each first edge block has a first piece and a connection portion. The first piece has two square faces perpendicularly connected. The connection portion is formed with the first piece and detachably connects with the inner arch plates of two adjacent inner shields and the outer arch plates of two adjacent outer shields.

Each second edge block has a second piece and an engagement piece. The second piece is formed on one end of the second edge block and has two square faces perpendicularly connected with each other. The engagement piece is formed on the other end of the second piece and detachably connects with the inner arch plates of two adjacent inner shields and the outer arch plates of two adjacent outer shields.

Each corner block is surrounded by three adjacent second edge blocks and has a corner body and a corner connection portion. The corner body has three square faces formed on one end of each corner block and perpendicularly connected with each other. The corner connection portion is formed on the other end of the corner body and detachably abuts against the inner sides of the inner arch plates of two adjacent inner shields.

Each center shaft of a multi-axis shaft unit of the central shaft assembly is combined with a movable inner shield. An outer shield is mounted on an outside of a corresponding inner shield with a spring and a screw. The inner shields and the outer shields are combined with the first intermediate blocks, second intermediate blocks, first edge blocks, second edge blocks and corner blocks to form the cube puzzle. Based on rotation of those blocks with respect to the movable inner shields and outer shields and sufficient tolerance among each block and corresponding inner shield and outer shield, smooth rotation of each block can be achieved without being affected by slightly skew block alignment.

Other objectives, advantages and novel features of the invention will become more apparent from the following detailed description when taken in conjunction with the accompanying drawings.

DETAILED DESCRIPTION OF THE INVENTION

Figure 1:
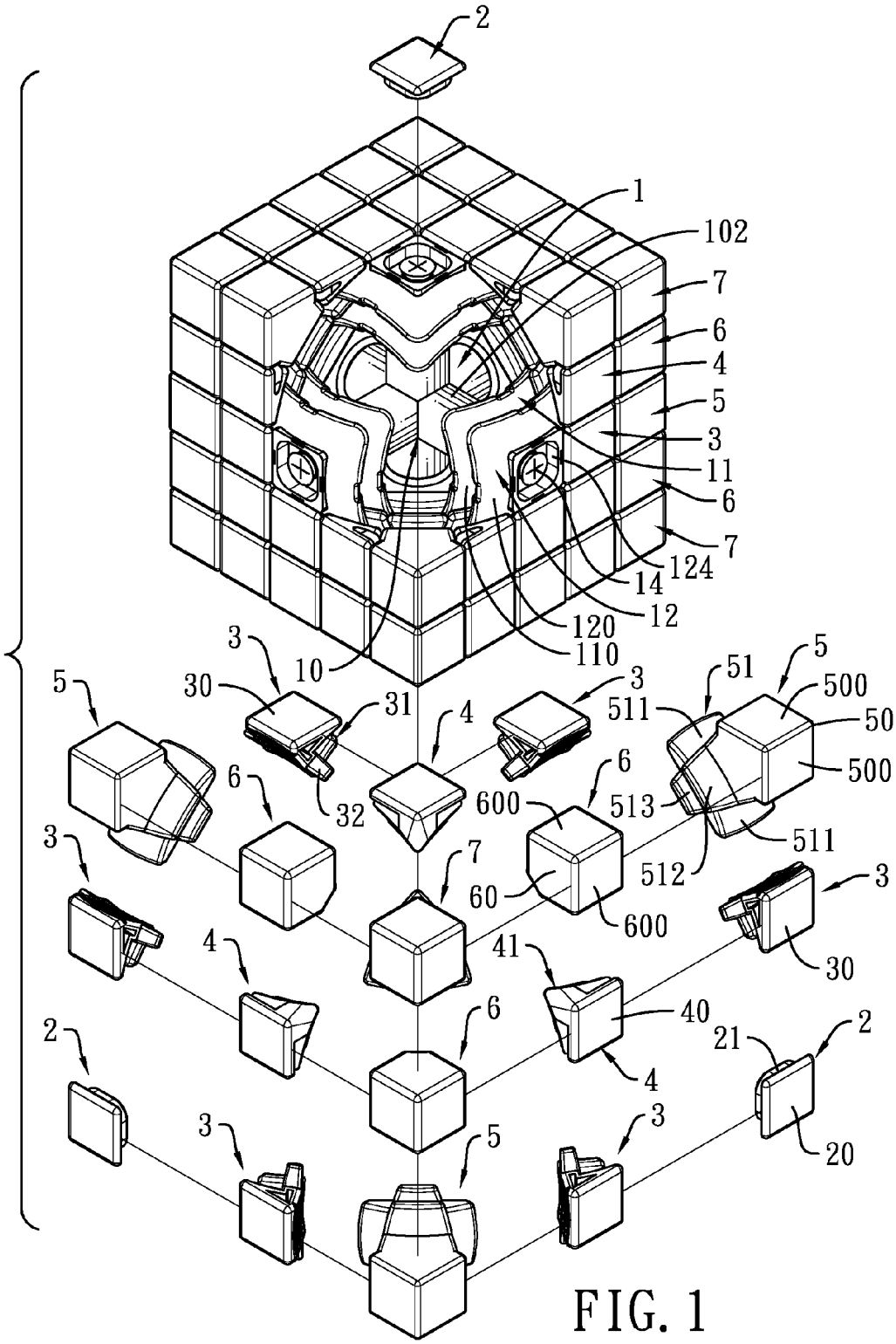
FIG. 1 is a first partially exploded perspective view of a five-by-five cube puzzle in accordance with the present invention.
Figure 2:
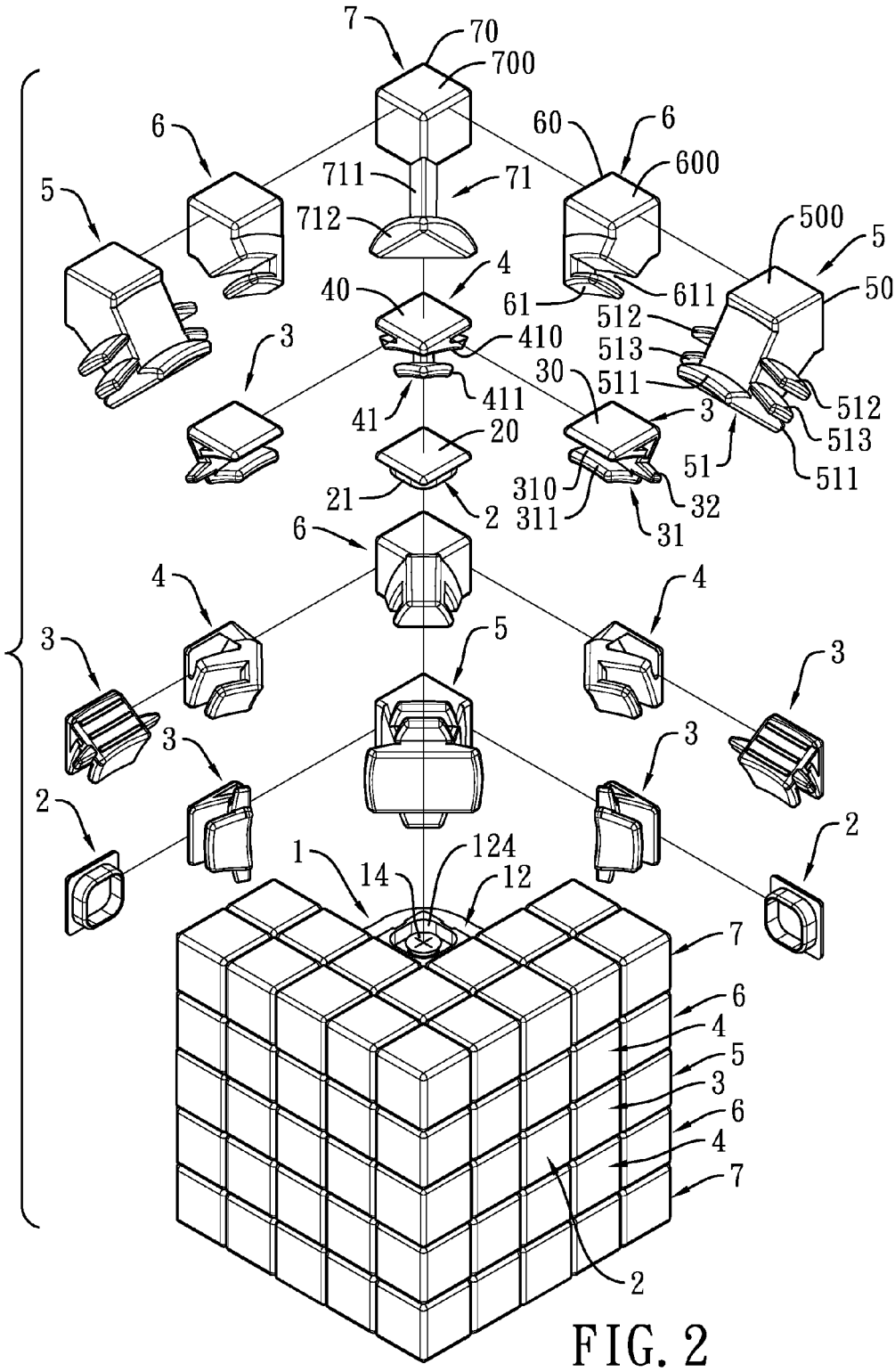
FIG. 2 is a second partially exploded perspective view of the five-by-five cube puzzle in FIG. 1.

With reference to FIGS. 1 and 2, a five-by-five cube puzzle has a central shaft assembly 1, six center blocks 2, twenty four first intermediate blocks 3, twenty four second intermediate blocks 4, twelve first edge blocks 5, twenty four second edge blocks 6 and eight corner blocks 7.

With reference to FIGS. 1, 2, 4 and 5, the central shaft assembly 1 has a multi-axis shaft unit 10, six inner shields 11 and six outer shields 12. The multi-axis shaft unit 10 has a base 101 and six center shafts 102. The center shafts 102 are formed on the base 101 to respectively point to six mutually perpendicular directions, namely front, rear, up, down, left and right. Each inner shield 11 has a square inner arch plate 110, a shaft sleeve 111 and a through hole 112. The shaft sleeve 111 is formed on and protrudes inwardly from an inner side of the inner arch plate 110, and is mounted around one of the center shafts 102 of the multi-axis shaft unit 10. The through hole 112 is centrally formed through the inner shield 11. Each outer shield has a square outer arch plate 120, a protruded shaft 121, a cavity 122, a receiving slot 123, a spring 13 and a screw 14. The protruded shaft 121 is formed on and protrudes inwardly from an inner side of the outer arch plate 120, and is centrally mounted through the through hole 112 of the inner shield 11. A free end of the protruded shaft 121 is detachably mounted in one of the center shafts 102 of the multi-axis shaft unit 10. The cavity 122 is formed in a free end of the protruded shaft 121. The receiving slot 123 is centrally formed through the outer shield 12 and axially formed in the protruded shaft 121 to communicate with the cavity 122. The spring 13 is mounted in the receiving slot 123 of the outer shield 12 and abuts against an inner wall of the receiving slot 123. The screw 14 is screwed into one of the center shafts 102 through the spring 13. Each inner shield 11 can be slidably movable along the axial direction of a corresponding protruded shaft 121. Each outer shield 12 can be moved outwardly and compress the spring 13, and a stroke of movement of the outer shield 12 is limited by an overall length of the screw 14. Accordingly, each outer shield 12 and a corresponding inner shield 11 can be relatively moved with respect to each other. In the present embodiment, the outer arch plate 120 of each outer shield 12 has a scarfed hole 124 formed in an outer surface of the outer arch plate 120 and communicating with the receiving slot 123 of the outer shield 12.

Figure 3:
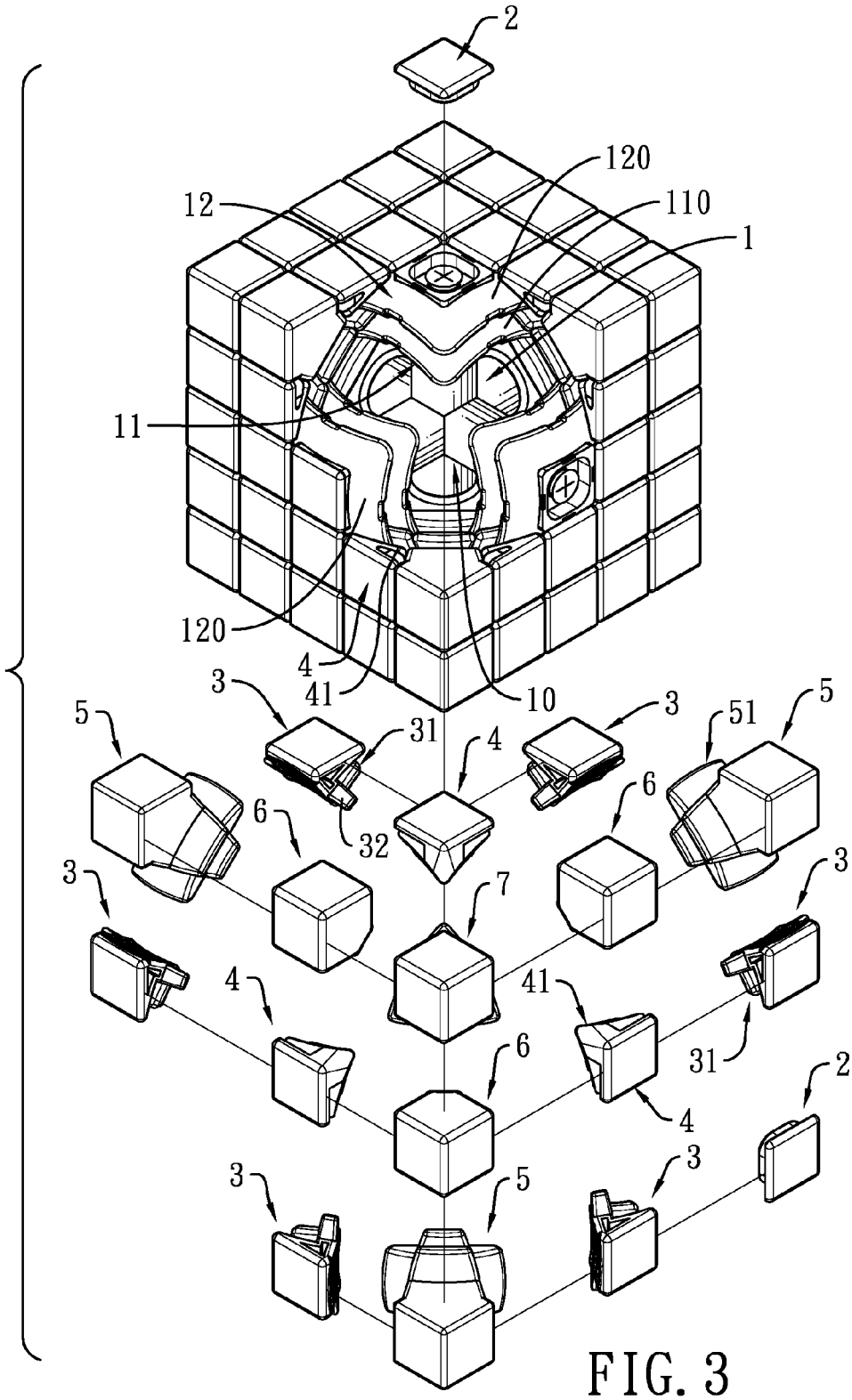
FIG. 3 is a third partially exploded perspective view of the five-by-five cube puzzle in FIG. 1.
Figure 4:
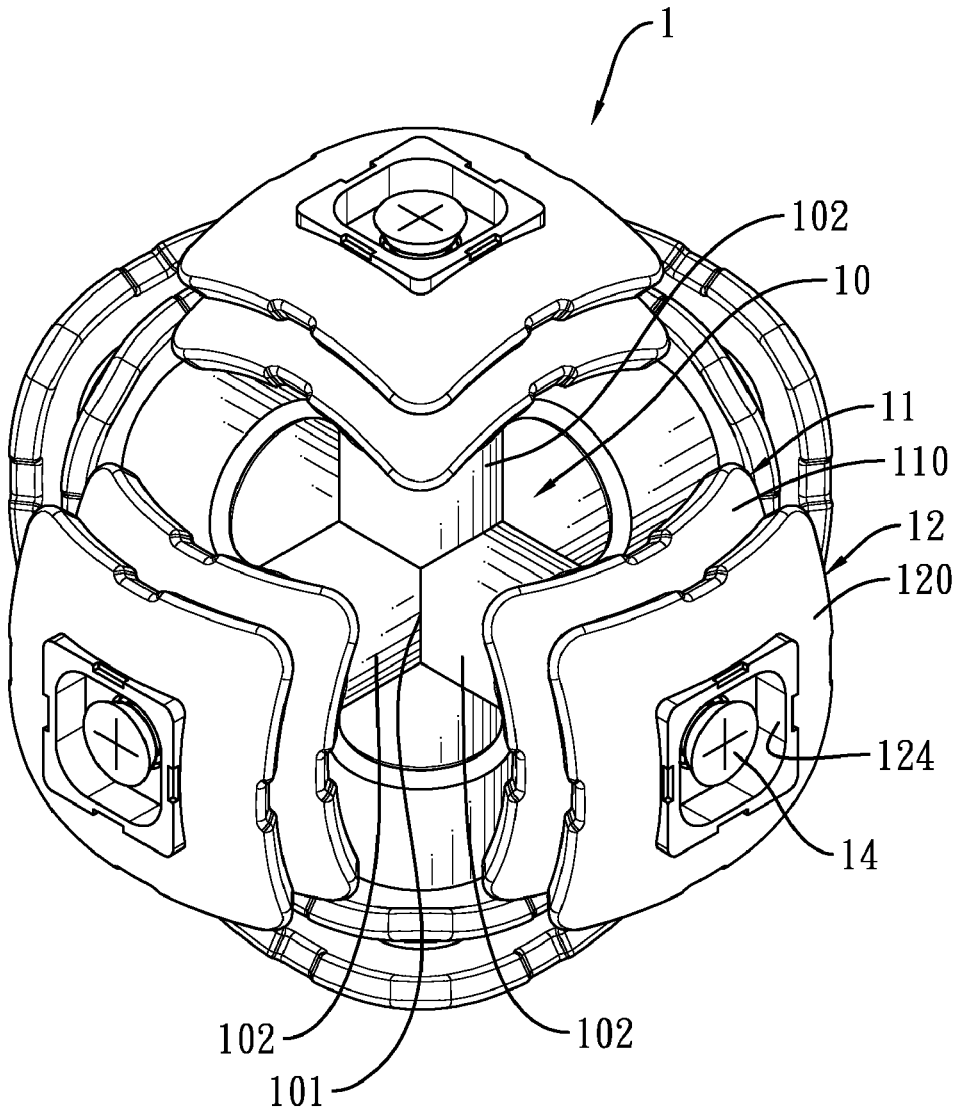
FIG. 4 is a perspective view of a central shaft assembly of the five-by-five cube puzzle in FIG. 1.

With reference to FIGS. 1 to 3, each center block 2 has a square plate 20 centrally mounted on the outer arch plate 120 of one of the outer shields 12 to cover the receiving slot 123. In the present embodiment, the center block 2 further has a fitting protrusion 21 formed on and protruding from an inner side of the square plate 20 of the center block 2, and fitted in the scarfed hole 124 of a corresponding outer arch plate 120.

With reference to FIGS. 6 to 14, the first intermediate blocks 3 are divided into six sets. Each set of the first intermediate blocks 3 are mounted on one side of the cube puzzle and is respectively mounted around one of the center blocks 2. Each first intermediate block 3 has a square plate 30 and a junction portion 31. One edge of the square plate 30 adjoins an edge of the square plate 20 of a corresponding center block 2. The junction portion 31 has an engagement wall 311, an engagement slot 310 and two ears 32. The engagement wall 311 is L-shaped and is formed on and protrudes from an inner side of the square plate 30. The engagement slot 310 is formed between the square plate 30 and the engagement wall 311. The ears 32 are respectively formed on and protrude from two sides of the junction portion 31 and are parallel to the engagement slot 310. An edge of the outer arch plate 120 of each outer shield 12 is inserted in the engagement slot 310 of a corresponding first intermediate block 3. Each engagement wall 311 is detachably mounted between the outer arch plate 120 of a corresponding outer shield 12 and the inner arch plate 110 of a corresponding inner shield 11. The ears 32 respectively and detachably abut against an edge of the outer arch plate 120 of a corresponding outer shield 12.

With further reference to FIG. 2, the second intermediate blocks 4 are divided into six sets. Each set of the second intermediate blocks 4 is mounted on one side of the cube puzzle. Each second intermediate block 4 is mounted between two adjacent first intermediate blocks 3 and diagonally adjacent to one corner of one of the center blocks 2. Each second intermediate block 4 has a square plate 40 and an assembling portion 41. Two adjacent edges of the square plate 40 respectively adjoin two edges of the square plates 30 of two adjacent first intermediate blocks 3. The assembling portion 41 has an assembling protrusion 411 and an assembling slot 410. The assembling protrusion 411 is L-shaped and formed on and protrudes from an inner side of the square plate 40. The assembling slot 410 is formed between the square plate 40 and the assembling protrusion 411. A corner of the outer arch plate 120 of each outer shield 12 and one ear 32 of one of the first intermediate blocks 3 detachably engages the assembling slot 410. The assembling protrusion 411 is detachably mounted between the outer arch plate 120 of a corresponding outer shield 12 and the inner arch plate 110 of a corresponding inner shield 11.

Each first edge block 5 has a first piece 50 and a connection portion 51. The first piece 50 has two square faces 500 perpendicularly connected. The square faces 500 of each first edge block 5 respectively adjoin the square plates 30 of two adjacent first intermediate blocks 3 on two adjacent sides of the five-by-five cube puzzle. The connection portion 51 is integrally formed with the first piece 50, and has two flanges 511, two inner wings 513 and two outer wings 512. The flanges 511 are arch, are oppositely and respectively formed on and protrude from two edges of a free end of the connection portion 51, and respectively and detachably abut against two inner sides of the inner arch plates 110 of two adjacent inner shields 11. The inner wings 513 are arch, are respectively formed on and protrude from two sides of the connection portion 51, align in a direction perpendicular to that of the flanges 511, respectively and detachably abut against two edges of the adjacent inner arch plates 110 of two adjacent inner shields 11. The outer wings 512 are arch, are respectively formed on and protrude from two sides of the connection portion 51, are parallel to the inner wings 513, and respectively and detachably abut against two corresponding ears 32 of two adjacent first intermediate blocks 3. With the structure combining the inner wings 513, the outer wings 512 of the first edge blocks 5, the ears 32 of the first intermediate blocks 3 and the inner arch plates 110 and the outer arch plates 120 of the central shaft assembly 1, a double-layer sphere is formed inside the five-by-five cube puzzle.

Each second edge block 6 has a second piece 60 and an engagement piece 61. The second piece 60 is formed on one end of the second edge block 6, and has two square faces 600 perpendicularly connected with each other. The engagement piece 61 is L-shaped and formed on an inner end of the second piece 60, and has a gap 611 formed between the second piece 60 and the engagement piece 61. Each second edge block 6 adjoins one of the first edge block 5 and two adjacent second intermediate blocks 4. The gap 611 is detachably mounted in by one of the outer wings 512 of a corresponding first edge block 5, and the engagement piece 61 is detachably mounted between the corresponding outer wing 512 and inner wing 513 of one adjacent first edge block 5.

Each corner block 7 is surrounded by three adjacent second edge blocks 6, and has a corner body 70 and a corner connection portion 71. The corner body 70 has three square faces 700 formed on one end of the corner block 7 and perpendicularly connected with each other. The corner connection portion 71 has a pole 711 and a triangular plate 712. The pole 711 is formed on an inner portion of the corner body 70. The triangular plate 712 is formed on a free end of the pole 711, and detachably abuts against the inner sides of the inner arch plates 110 of two adjacent inner shields 11.

Figure 5:
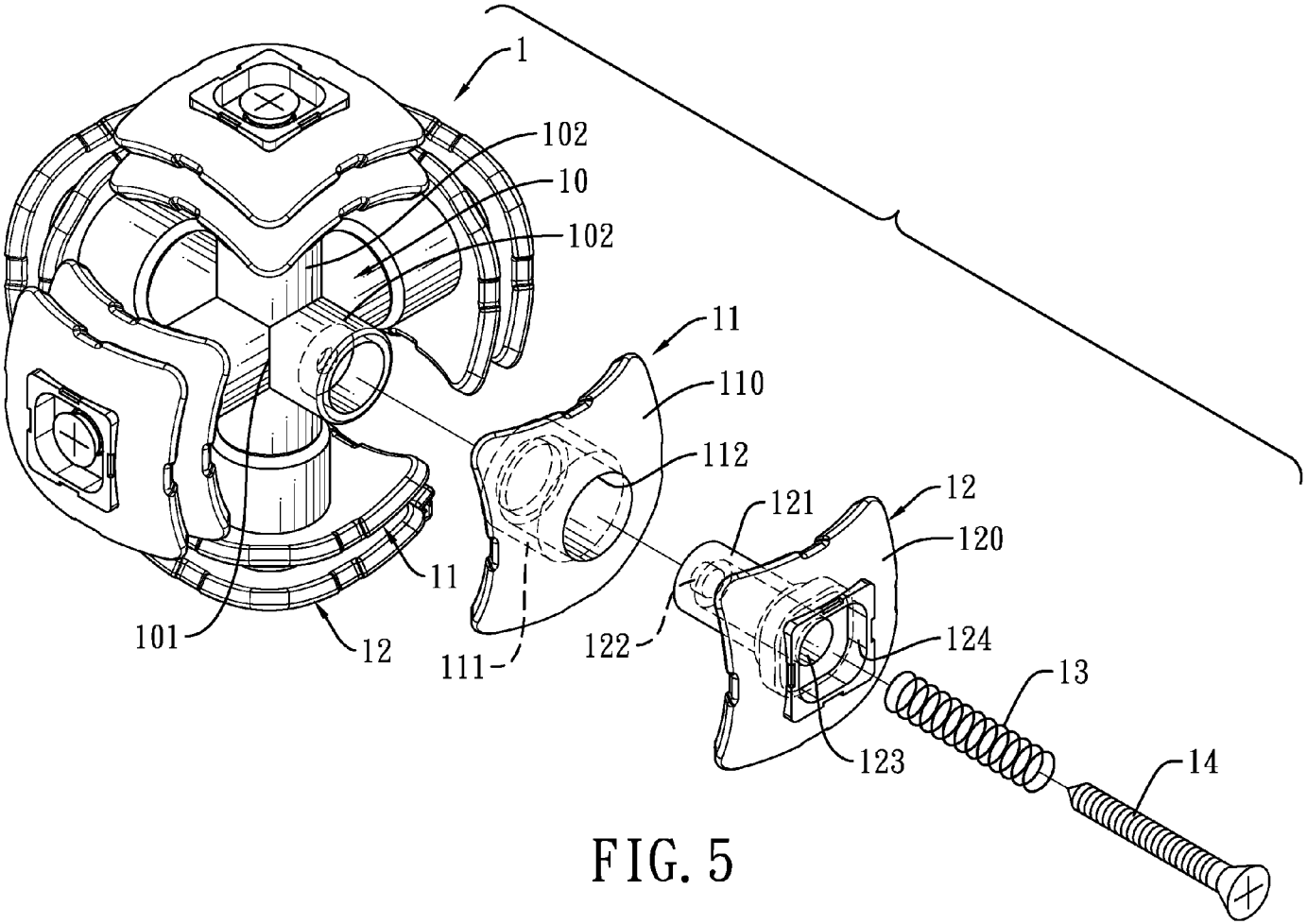
FIG. 5 is a partially exploded perspective view of the central shaft assembly of the five-by-five cube puzzle in FIG. 4.
Figure 6:
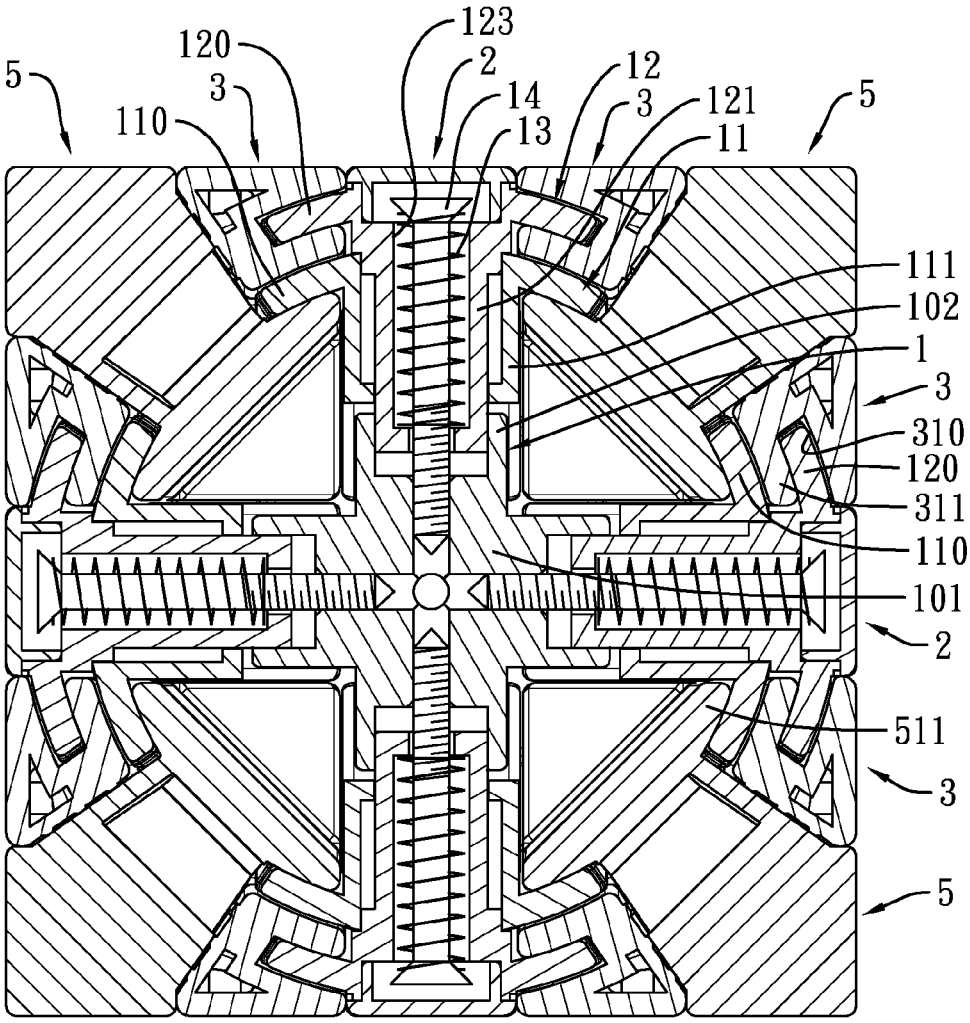
FIG. 6 is a side view in partial section of the five-by-five cube puzzle in FIG. 1.
Figure 7:
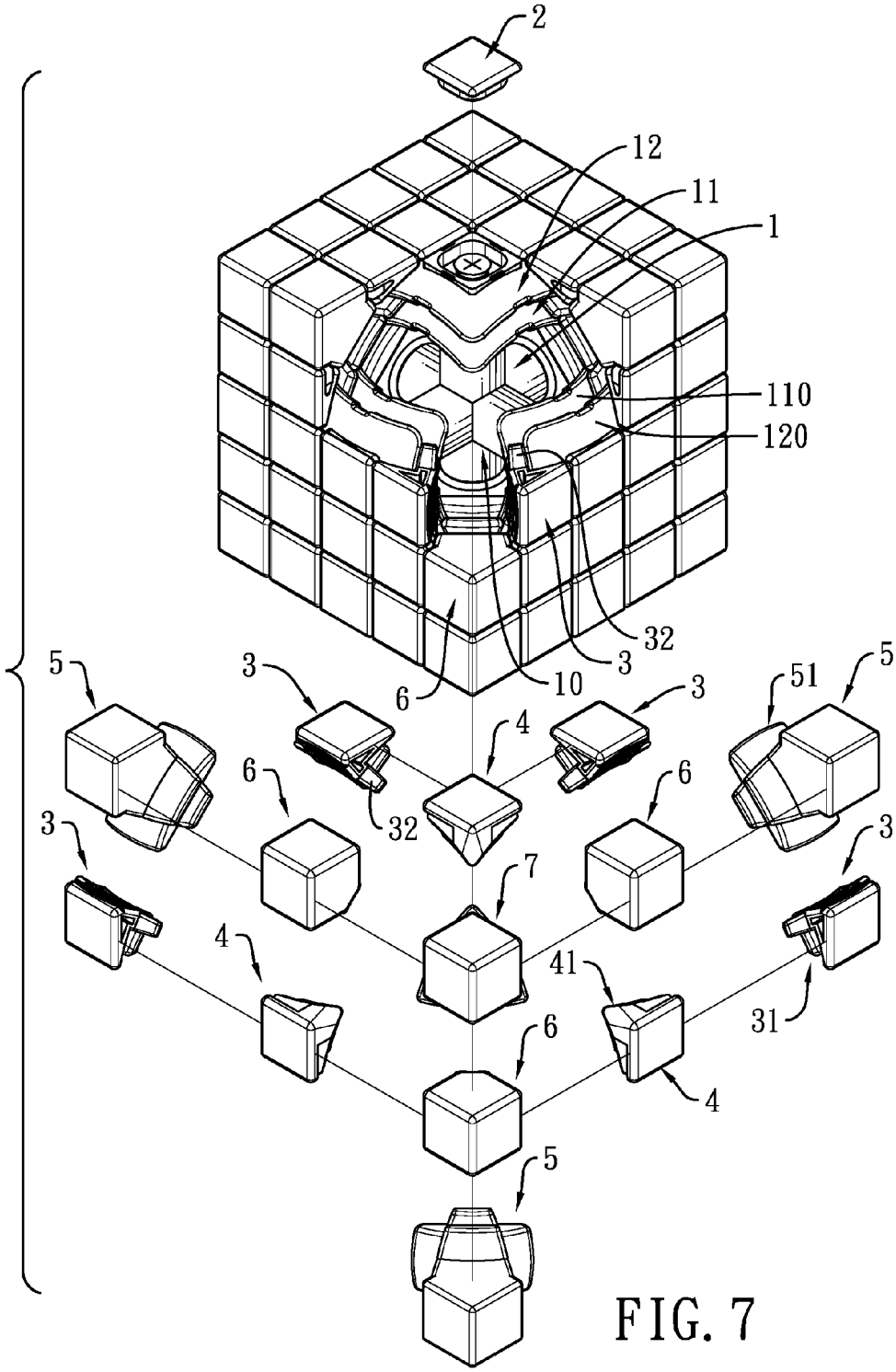
FIG. 7 is a fourth partially exploded perspective view of the five-by-five cube puzzle in FIG. 1.
Figure 8:
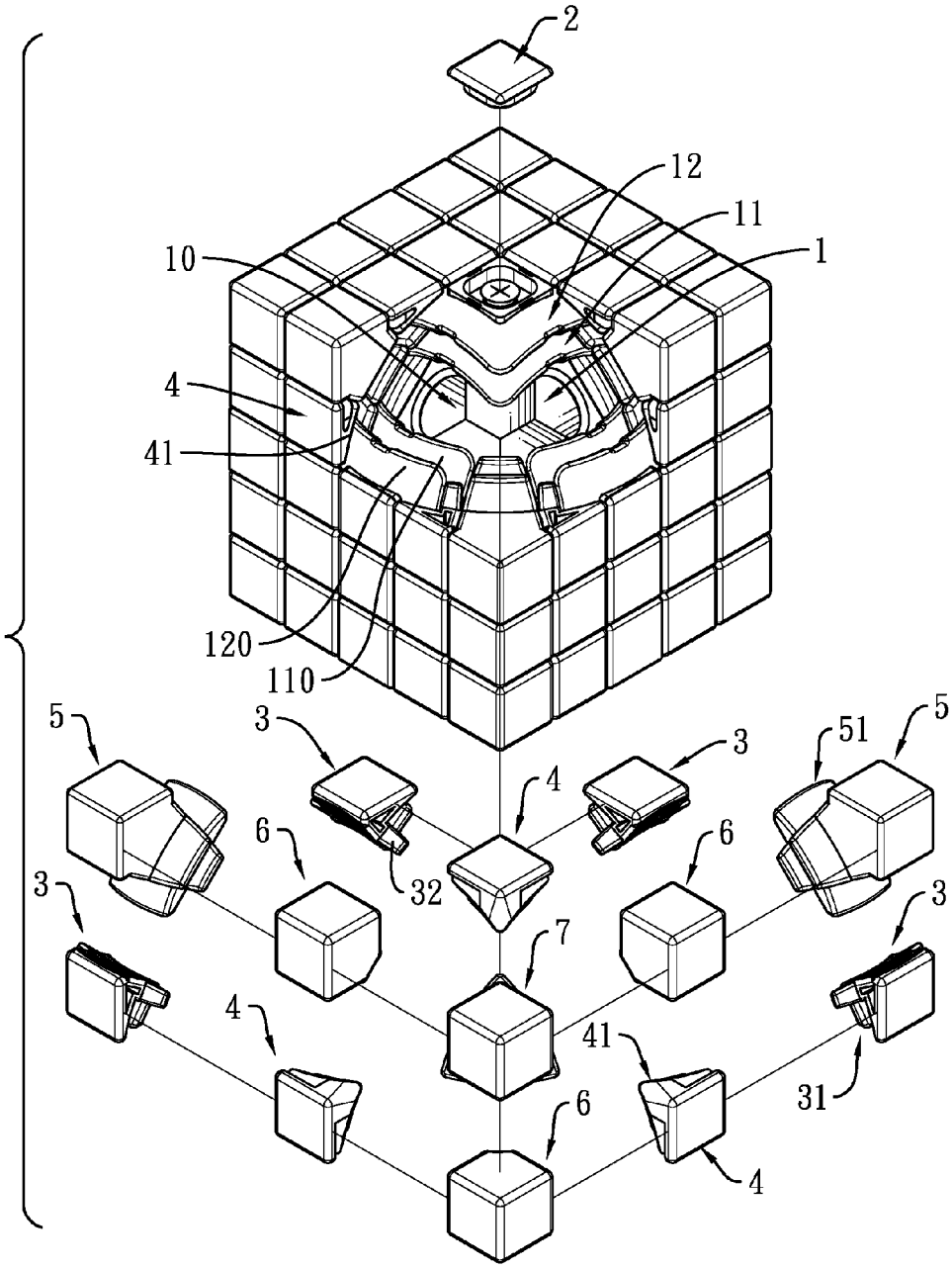
FIG. 8 is a fifth partially exploded perspective view of the five-by-five cube puzzle in FIG. 1.
Figure 9:
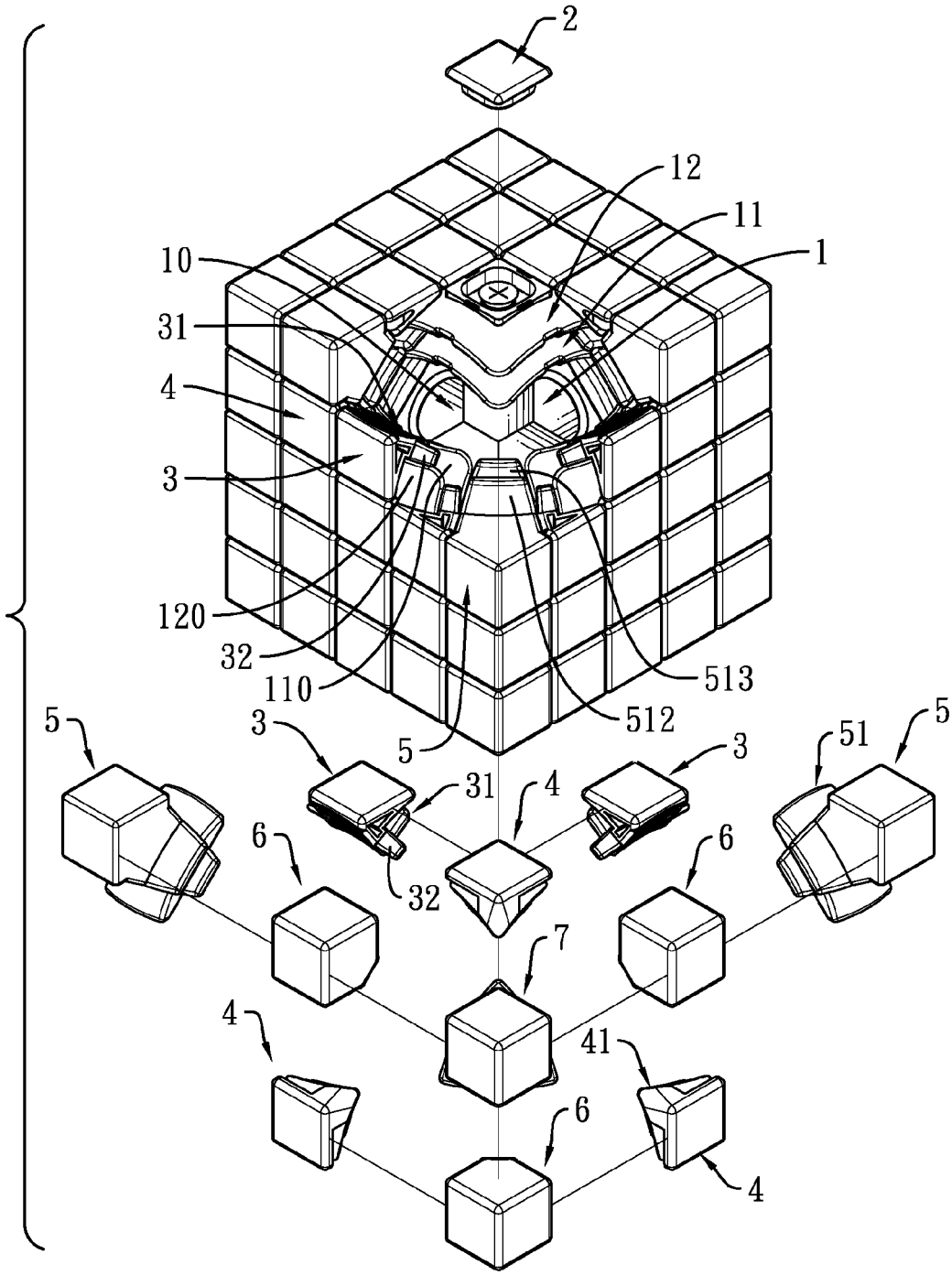
FIG. 9 is a sixth partially exploded perspective view of the five-by-five cube puzzle in FIG. 1.
Figure 10:
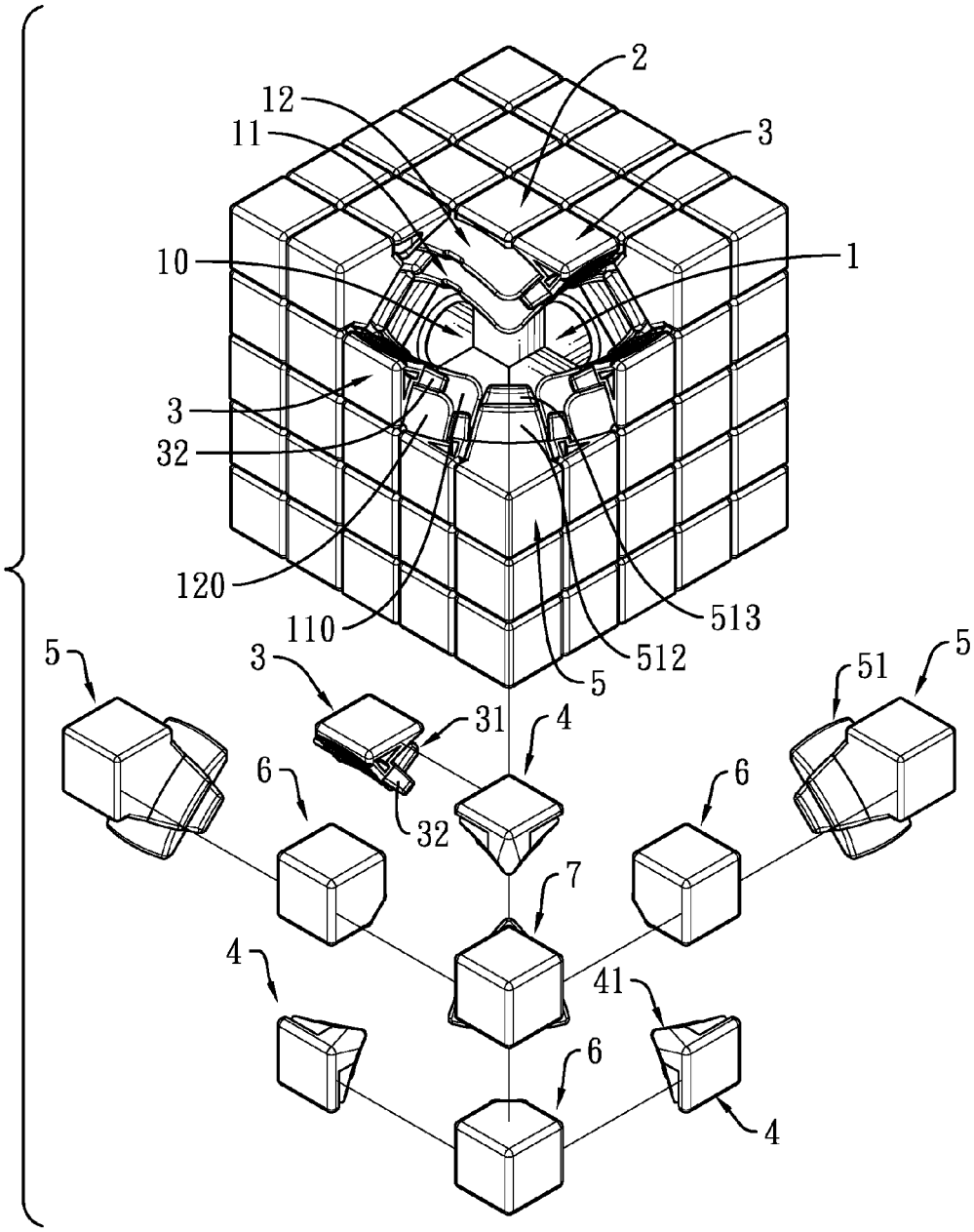
FIG. 10 is a seventh partially exploded perspective view of the five-by-five cube puzzle in FIG. 1.
Figure 11:
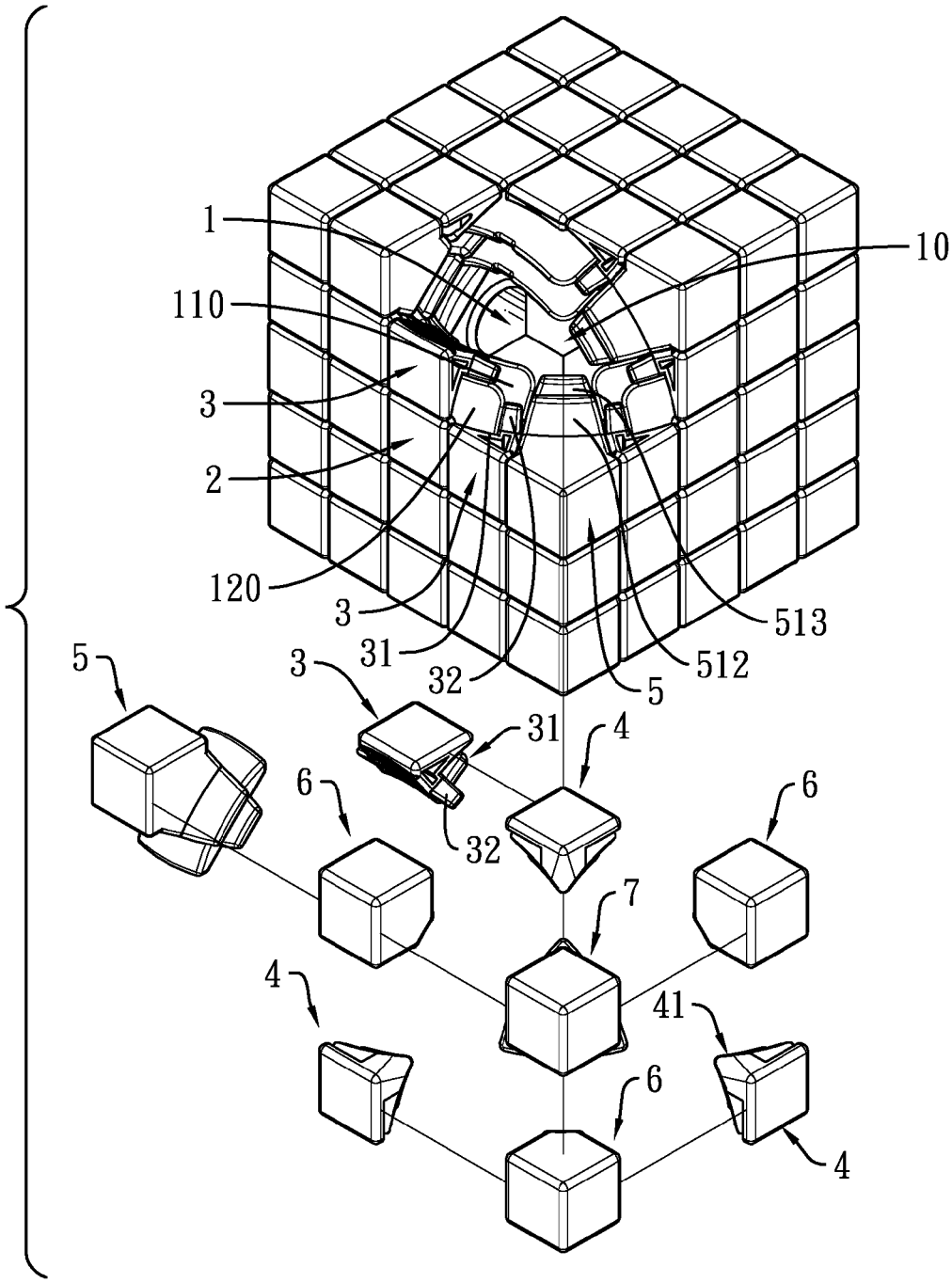
FIG. 11 is an eighth partially exploded perspective view of the five-by-five cube puzzle in FIG. 1.
Figure 12:
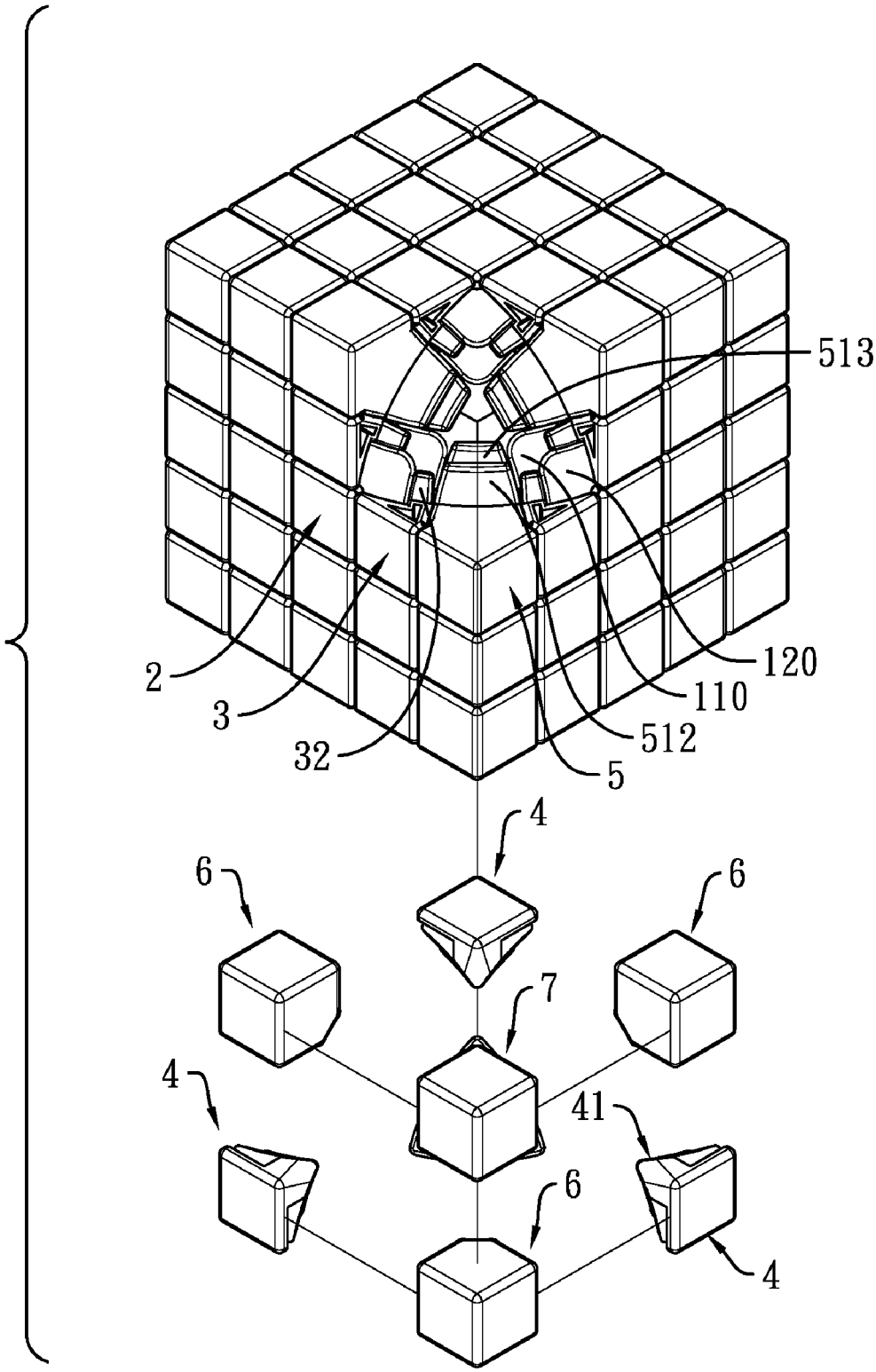
FIG. 12 is a ninth partially exploded perspective view of the five-by-five cube puzzle in FIG. 1.
Figure 13:
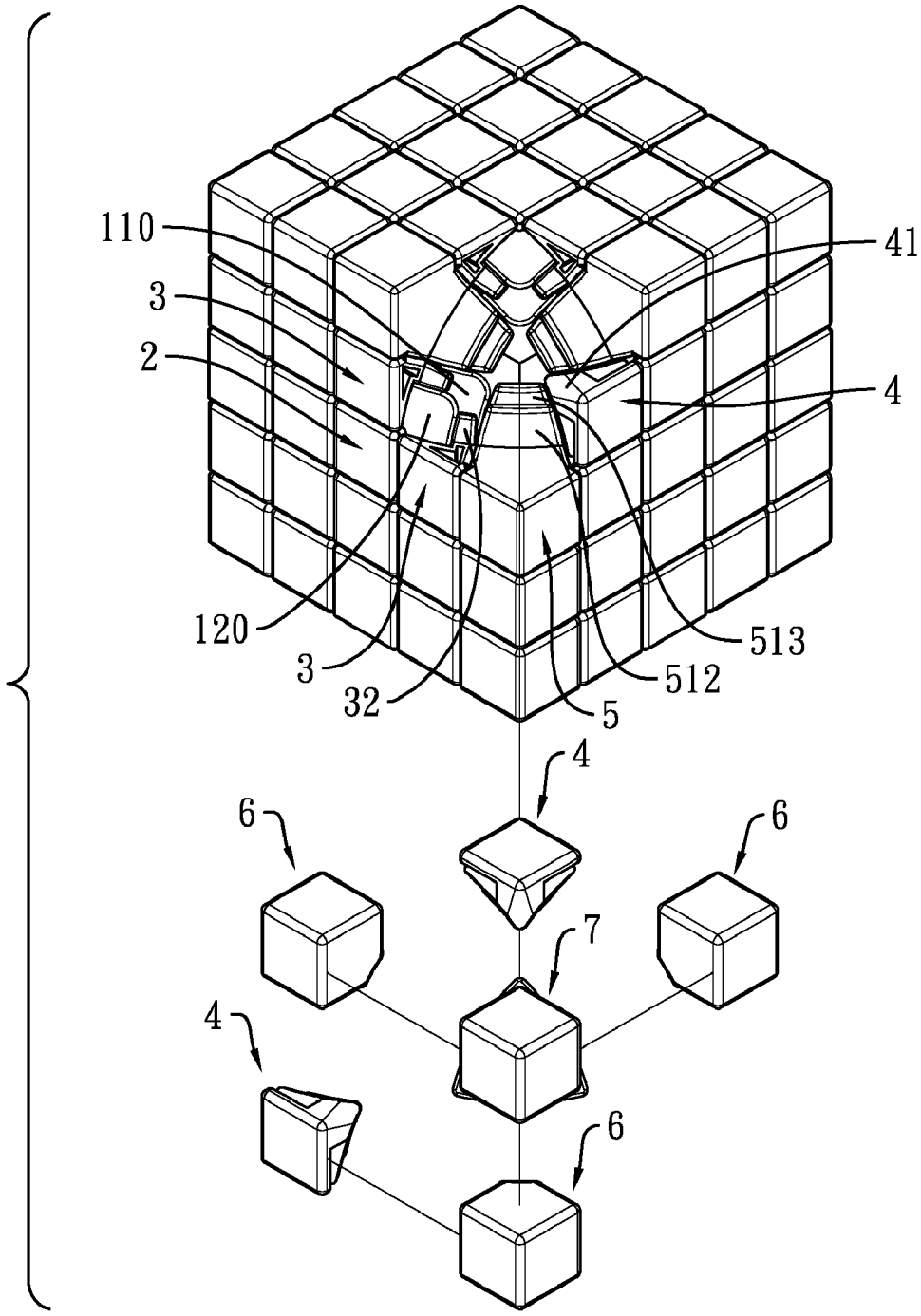
FIG. 13 is a tenth partially exploded perspective view of the five-by-five cube puzzle in FIG. 1.
Figure 14:
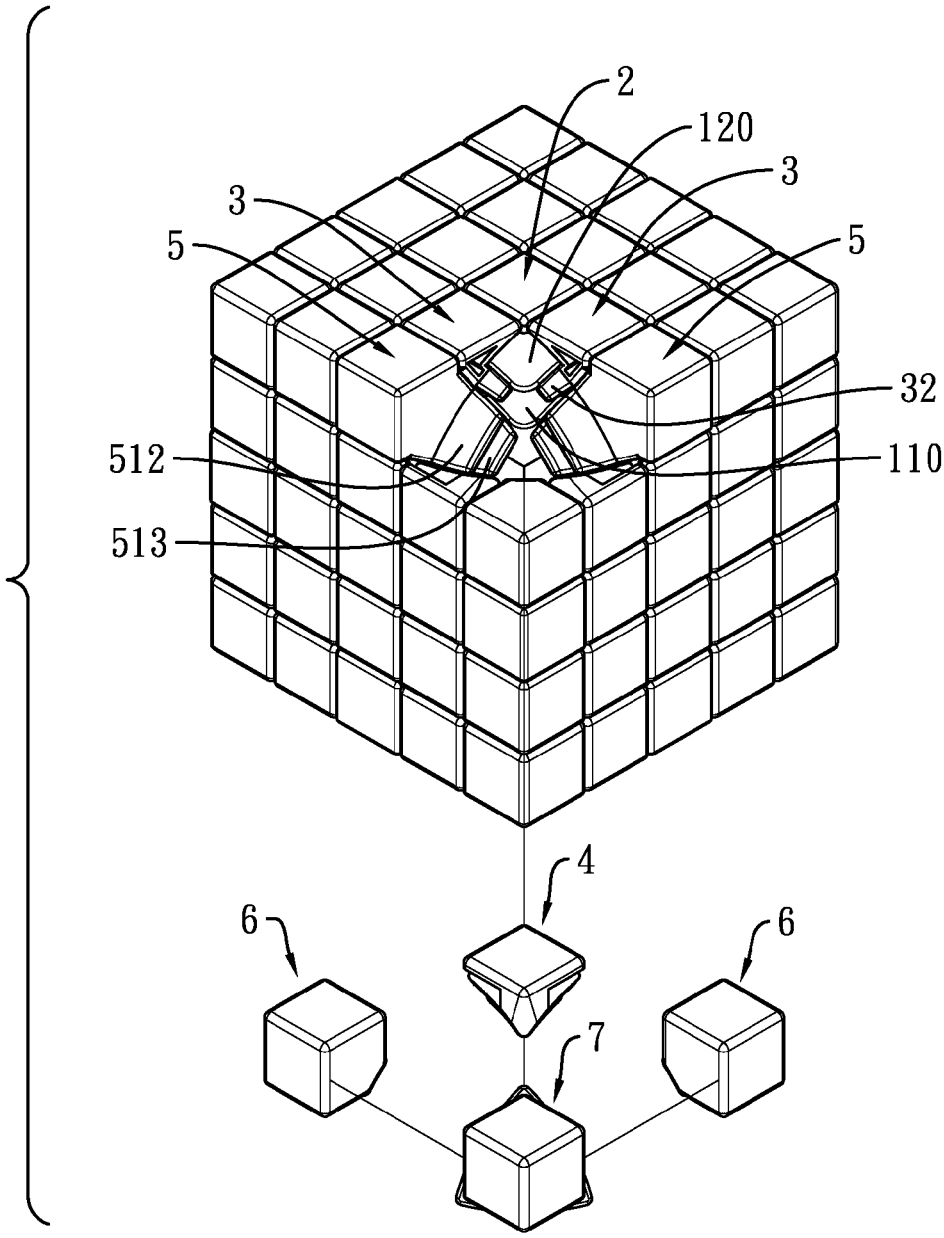
FIG. 14 is an eleventh partially exploded perspective view of the five-by-five cube puzzle in FIG. 1.
Figure 15:
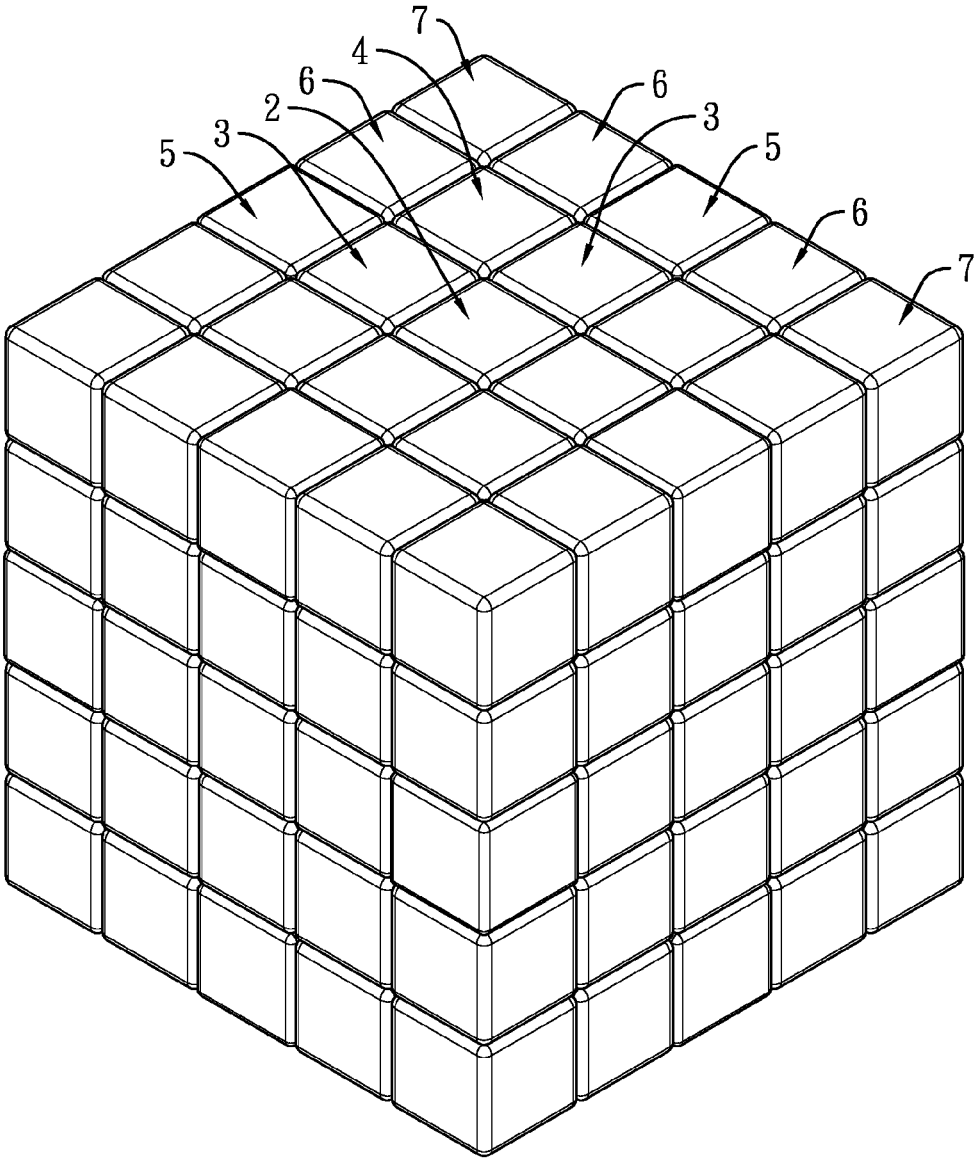
FIG. 15 is a perspective view of the five-by-five cube puzzle in FIG. 1.

With reference to FIG. 15, the five-by-five cube puzzle has five layers of blocks horizontally and vertically. With reference to FIGS. 1, 2 and 5, the center shafts 102 of the multi-axis shaft unit 10 are respectively mounted on the movable inner shields 11. The inner shields 11 are respectively combined with the outers shield 12, the first intermediate blocks 3, the second intermediate blocks 4, the first edge blocks 5, the second edge blocks 6 and the corner block 7 to form a five-by-five cube puzzle as shown in FIG. 15. To be rotatable relative to the movable inner shields 11 and the outer shields 12, the first intermediate blocks 3, the second intermediate blocks 4, the first edge blocks 5, the second edge blocks 6 and the corner block 7 can be easily mounted between the inner shields 11 and the outer shields 12 with sufficiently large gaps between the inner shields 11 and the outer shields 12 arising from the relative movement between the inner shields 11 and the outer shields 12, thereby enhancing the rotational smoothness in rotating each layer of blocks of the five-by-five cube puzzle. Accordingly, when the first intermediate blocks 3, the second intermediate blocks 4, the first edge blocks 5, the second edge blocks 6 and the corner blocks 7 are operated and slightly deviate from straight or level positions at which those blocks are supposed to be located, and those blocks are not blocked or squeezed by the central shaft assembly 1 and can still be rotatable.

The center blocks 2, the first intermediate blocks 3, the second intermediate blocks 4, the first edge blocks 5, the second edge blocks 6 and the corner blocks 7 can be formed with colors or patterns thereon. The colors or patterns on the six outer surfaces are different so as to be distinctly distinguished.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A five-by-five cube puzzle comprising:

a central shaft assembly having:

a multi-axis shaft unit having:

a base; and six center shafts formed on the base to respectively point to six mutually perpendicular directions;

six inner shields, each having an inner arch plate being square and detachably mounted around one of the center shafts; and six outer shields, each having:

an outer arch plate being square;

a protruded shaft formed on and protruding inwardly from an inner side of the outer arch plate, and centrally mounted through the inner shield;

a spring mounted in the outer shield; and a screw screwed into one of the center shafts through the spring so that a corresponding outer shield is movable along an axial direction of the protruded shaft and a stroke of movement of the outer shield is limited by an overall length of the screw;

six center blocks, each having a square plate centrally mounted on the outer arch plate of one of the outer shields;

twenty four first intermediate blocks divided into six sets respectively mounted around the center blocks, each having:

a square plate, wherein one edge of the square plate adjoins a corresponding edge of the square plate of a corresponding center block; and a junction portion detachably engaging the outer arch plate of one of the outer shields, and having two ears respectively formed on and protruding from two sides of the junction portion, and each ear detachably abutting against an edge of the outer arch plate of a corresponding outer shield;

twenty four second intermediate blocks, each mounted between two adjacent first intermediate blocks, being diagonally adjacent to one corner of one of the center blocks and having:

a square plate, wherein two adjacent edges of the square plate respectively adjoin two edges of the square plates of two adjacent first intermediate blocks; and an assembling portion formed on an inner side of the second intermediate block and detachably engaging the outer arch plate of one of the outer shields;

twelve first edge blocks mounted between two adjacent first intermediate blocks on two adjacent sides of the cube puzzle, each having:

a first piece having two square faces perpendicularly connected; and a connection portion formed with the first piece and detachably connecting with the inner arch plates of two adjacent inner shields and the outer arch plates of two adjacent outer shields;

twenty four second edge blocks, each having:

a second piece formed on one end of the second edge block and having two square faces perpendicularly connected with each other; and an engagement piece formed on the other end of the second piece and detachably connecting with the inner arch plates of two adjacent inner shields and the outer arch plates of two adjacent outer shields; and eight corner blocks, each surrounded by three adjacent second edge blocks, and having:

a corner body having three square faces formed on one end of each corner block and perpendicularly connected with each other; and a corner connection portion formed on the other end of the corner body and detachably abutting against the inner sides of the inner arch plates of two adjacent inner shields.

2. The five-by-five cube puzzle as claimed in claim 1, wherein each inner shield of the central shaft assembly further has:

a shaft sleeve formed on and protruding inwardly from an inner side of the inner arch plate, and mounted around a corresponding center shaft of the multi-axis shaft unit; and a through hole centrally formed through the inner shield;

each outer shield of the central shaft assembly further has:

a cavity formed in a free end of the protruded shaft; and a receiving slot centrally formed through the outer shield and axially formed in the protruded shaft to communicate with the cavity;

wherein the protruded shaft is centrally mounted through the through hole of the inner shield, a free end of the protruded shaft is detachably mounted in a corresponding center shaft of the multi-axis shaft unit, and the spring is mounted in the receiving slot;

the junction portion of each first intermediate block further having:

an engagement wall being L-shaped and formed on and protruding from an inner side of the square plate; and an engagement slot formed between the square plate of the first intermediate block and the engagement wall and being parallel to the ears;

wherein an edge of the outer arch plate of each outer shield is inserted in the engagement slot of a corresponding first intermediate block, and each engagement wall is detachably mounted between the outer arch plate of a corresponding outer shield and the inner arch plate of a corresponding inner shield;

the assembling portion of each second intermediate block is formed on an inner side of the second intermediate block and has:

an assembling protrusion being L-shaped and formed on and protruding from an inner side of the square plate; and an assembling slot formed between the square plate of the second intermediate block and the assembling protrusion;

wherein a corner of the outer arch plate of each outer shield and one ear of one of the first intermediate blocks detachably engages the assembling slot, and the assembling protrusion is detachably mounted between the outer arch plate of a corresponding outer shield and the inner arch plate of a corresponding inner shield;

the connection portion of each first edge block has:

two flanges being arch, oppositely and respectively formed on and protruding from two edges of a free end of the connection portion, and respectively and detachably abutting against two inner sides of the inner arch plates of two adjacent inner shields;

two inner wings being arch, respectively formed on and protruding from two sides of the connection portion, and detachably abutting against two edges of two adjacent inner arch plates; and two outer wings being arch, respectively formed on and protruding from two sides of the connection portion, being parallel to the inner wings, aligning in a direction perpendicular to that of the flanges, and respectively and detachably abutting against corresponding ears of two adjacent first intermediate blocks;

the engagement piece of each second edge block is L-shaped and has a gap formed between the second piece and the engagement piece, wherein the gap is inserted in by one of the outer wings of a corresponding first edge block, and the engagement piece is detachably mounted between the corresponding outer wing and inner wing of one adjacent first edge block; and the corner connection portion of each corner block has:

a pole formed on the corner body; and a triangular plate formed on a free end of the pole, and detachably abutting against the inner sides of the inner arch plates of two adjacent inner shields.

3. The five-by-five cube puzzle as claimed in claim 2, wherein the outer arch plate of each outer shield has a scarfed hole formed in an outer surface of the outer arch plate and communicating with the receiving slot of the outer shield; and each center block further has a fitting protrusion formed on and protruding from an inner side of the square plate of the center block, and fitted in the scarfed hole of the outer arch plate of a corresponding outer shield.

* * * * *